US009428983B2

(12) United States Patent
Mann et al.

(10) Patent No.: US 9,428,983 B2
(45) Date of Patent: Aug. 30, 2016

(54) TOP ENTRY WIRELINE APPARATUS AND METHODS

(71) Applicant: Canrig Drilling Technology Ltd., Houston, TX (US)

(72) Inventors: Chance E. Mann, Dripping Springs, TX (US); Ronald E. Haws, Houston, TX (US)

(73) Assignee: Canrig Drilling Technology Ltd.

( * ) Notice: Subject to any disclaimer, the term of this patent is extended or adjusted under 35 U.S.C. 154(b) by 374 days.

(21) Appl. No.: 13/967,479

(22) Filed: Aug. 15, 2013

(65) Prior Publication Data

US 2015/0013992 A1 Jan. 15, 2015

Related U.S. Application Data

(60) Provisional application No. 61/846,125, filed on Jul. 15, 2013.

(51) Int. Cl.
*E21B 33/06* (2006.01)
*E21B 33/072* (2006.01)

(52) U.S. Cl.
CPC ..... *E21B 33/072* (2013.01)

(58) Field of Classification Search
CPC ..... E21B 33/072; E21B 19/00; E21B 19/08; E21B 19/22; B65H 57/14
See application file for complete search history.

(56) References Cited

U.S. PATENT DOCUMENTS 3,363,880 A * 1/1968 Blagg ..... E21B 19/22 166/75.11
4,428,421 A 1/1984 Rankin
4,469,171 A * 9/1984 Mine ..... E21B 19/22 166/85.5
4,899,816 A * 2/1990 Mine ..... E21B 19/22 166/385
5,735,351 A 4/1998 Helms
6,105,939 A * 8/2000 Vance ..... B66D 1/36 254/405
6,907,934 B2 6/2005 Kauffman et al.
7,503,397 B2 * 3/2009 Giroux ..... E21B 7/20 166/241.5
7,703,540 B2 * 4/2010 Webre ..... E21B 17/026 166/379
8,091,629 B2 * 1/2012 Fogg ..... E21B 33/072 166/385
8,347,971 B2 * 1/2013 Webre ..... E21B 17/026 166/379
2004/0221994 A1 11/2004 Kauffman et al.
2005/0045343 A1 3/2005 Bixenman et al.
2006/0032638 A1 * 2/2006 Giroux ..... E21B 7/20 166/377
2007/0209804 A1 * 9/2007 Webre ..... E21B 17/026 166/379
2008/0264650 A1 * 10/2008 Begnaud ..... E21B 17/026 166/381
2009/0101359 A1 4/2009 Kauffman et al.
2010/0038094 A9 * 2/2010 Webre ..... E21B 17/026 166/379

(Continued)

FOREIGN PATENT DOCUMENTS

WO WO 9630624 A1 * 10/1996 ..... E21B 19/00
WO WO 2005/049956 6/2005
WO WO 2007/009248 1/2007

OTHER PUBLICATIONS

International Search Report and Written Opinion issued for PCT/US2014/043007 dated Oct. 22, 2014, 11 pgs.

*Primary Examiner* — Jennifer H Gay
(74) *Attorney, Agent, or Firm* — Haynes & Boone, LLP

(57) ABSTRACT

A top entry wireline apparatus may be used to insert or manipulate an electrical conduit into a wellbore. The top entry wireline apparatus may include a roller chain configuration that may include a plurality of roller bodies. A method of using the top entry wireline apparatus is also included.

20 Claims, 9 Drawing Sheets

(56) References Cited

U.S. PATENT DOCUMENTS

2013/0186640 A1* 7/2013 Webre ..... E21B 17/026
166/379

2014/0174727 A1* 6/2014 Huizer ..... E21B 47/04
166/250.01

2015/0013992 A1* 1/2015 Mann ..... E21B 33/072
166/379

* cited by examiner

TOP ENTRY WIRELINE APPARATUS AND METHODS

PRIORITY

The present application claims priority to and the benefit of the filing date of U.S. Patent Application No. 61/846,125, titled "Top Entry Wireline Apparatus and Methods", filed Jul. 15, 2013, which is incorporated herein by reference.

TECHNICAL FIELD

The disclosure is directed to a top entry wireline apparatus for inserting and manipulating a wireline, along with methods of using such top entry wireline apparatus.

BACKGROUND OF THE DISCLOSURE

Top drive systems are used to rotate a drill string made up of tubulars within a wellbore. In many drilling operations, drilling operators need to lower equipment or measurement devices into the well for purposes of well intervention, reservoir evaluation and pipe recovery. In order to accomplish this, operators drop a series of electrical conduits, typically referred to as wirelines, through the top drive system and into the wellbore. The wireline provides power to equipment located at the end of the conduit and provides a pathway for electrical communication between the surface and the equipment at the end of the conduit adjacent the bottom of the wellbore.

Typically, a top entry wireline apparatus is attached to the top drive system to facilitate the entry of the wireline into the wellbore. However, stringing in the wireline from above the top drive can be dangerous if the system used is inadequate to support the weight of the wireline or if it is unable to adapt to the turns and twists of the drilling tubes as drilling operations continue.

Top entry wireline apparatuses generally consist of sheave and pulley systems. These systems are large and bulky, however, and if a component of the system breaks, the entire apparatus typically must be taken apart and repaired. Thus, the present disclosure seeks to eliminate these disadvantages by providing a unique structural arrangement for the apparatus that is compact, can be universally adapted to a variety of top drive systems, and can be repaired without disassembly of the top drive.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
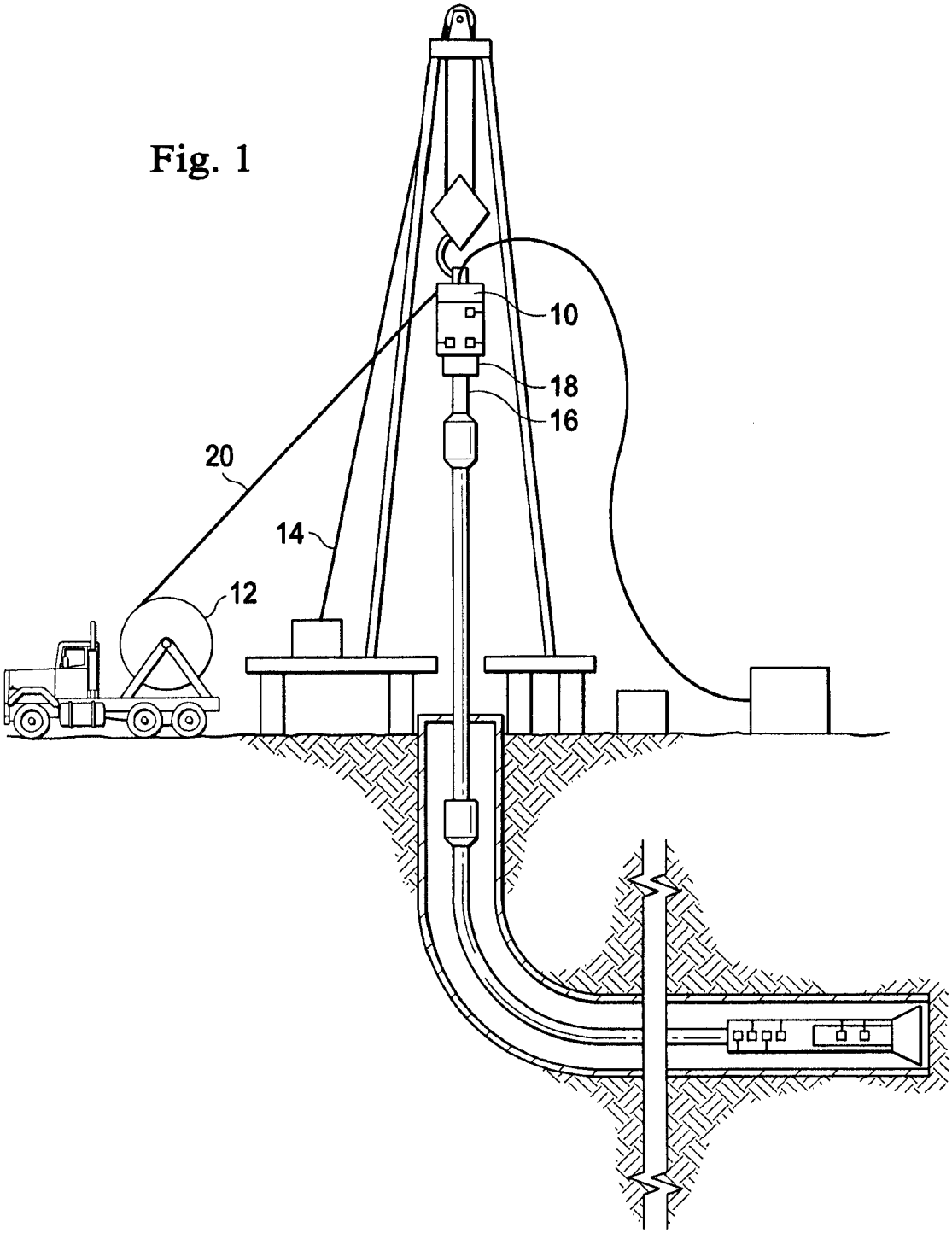
FIG. 1 is an elevation view of a top drive drilling rig with a top entry wireline apparatus installed thereon according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure provides for an apparatus and method for inserting and manipulating a wireline into a wellbore through a top drive unit. Because of its structural arrangement, the apparatus, which in some aspects is a top entry wireline apparatus, may be arranged to accomplish its desired functions while maintaining a lower profile than conventional systems. Because of its lower profile, the top entry wireline apparatus may be introduced onto various rigs, even being compatible with rigs by different manufacturers. In some aspects, the top entry wireline apparatus employs a plurality of roller chains to achieve a low profile. The low profile may enable the top entry wireline apparatus to fit between rig components, such as, for example only, between a top drive unit and suspension components carrying the top drive unit. The plurality of roller chains guide a wireline from a location laterally spaced from a well-center to a location above the well-center, so that the wireline may run downward into the drill string. Some aspects also include a separable portion, such as an assembly door, that may enable easier feeding of the wireline into the top entry wireline apparatus than conventional systems. This may reduce set-up time, thereby decreasing overall costs. A downhole tool may be attached to the wireline.

Figure 2:
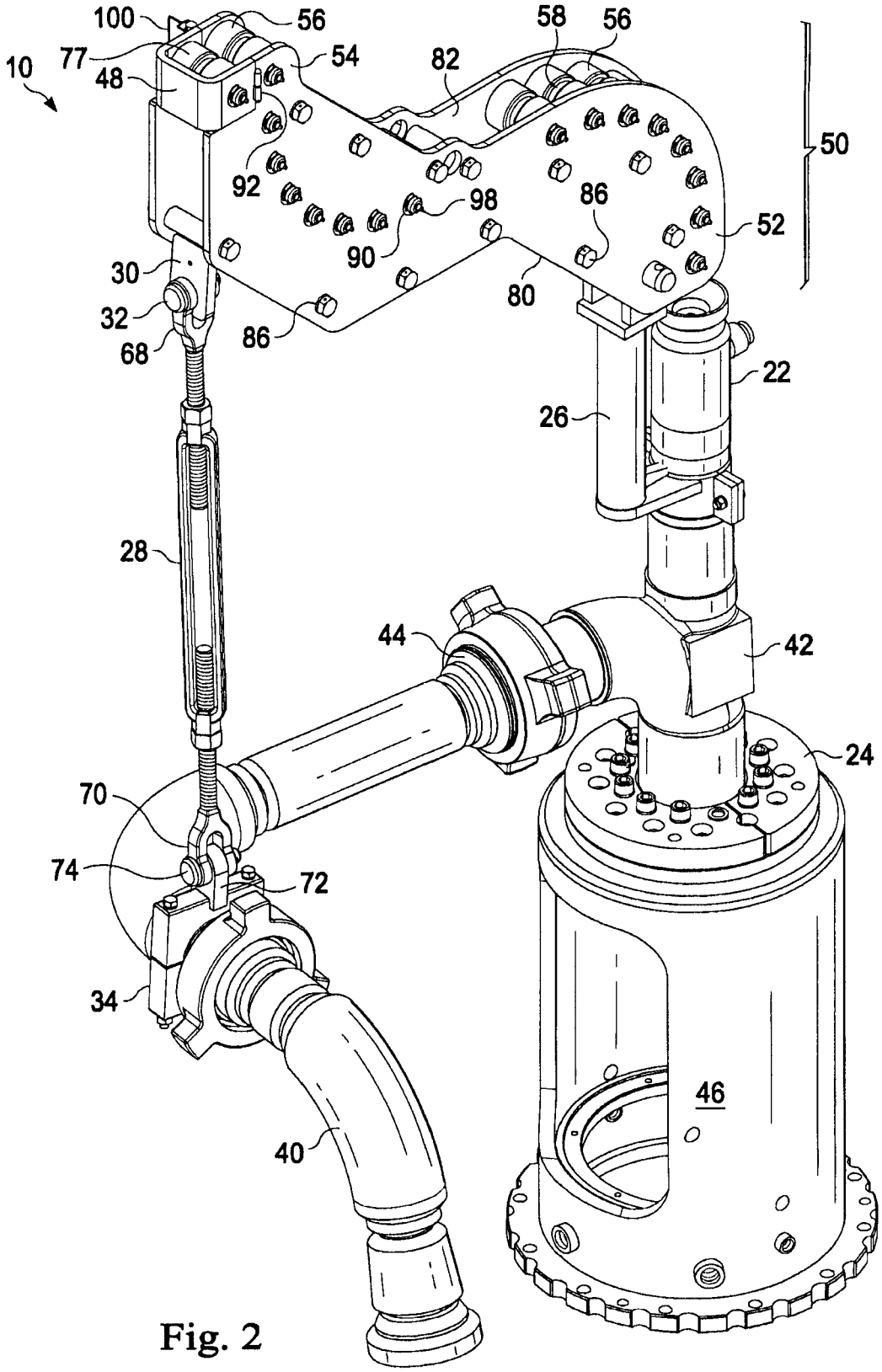
FIG. 2 is a perspective view of the top entry wireline apparatus with pack-off body installed thereon according to one or more aspects of the present disclosure.

Referring to FIG. 1, an overview of the overall drilling system is illustrated demonstrating one or more aspects of the present disclosure. A wireline supply 12 is rigged up for operation in a land-based drilling rig 14. One or more aspects of the present disclosure, however, are readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure. Drill pipe 16 may be rotated by top drive unit 18. A wireline 20 is fed into the distal portion of top entry wireline apparatus 10, such as via a hinged door 48 (FIG. 2). The top entry wireline apparatus 10 is mounted above top drive unit 18.

FIG. 2 shows a perspective view of the top entry wireline apparatus 10 connected to additional components that make up a part of the drilling rig 14 in FIG. 1. The top entry wireline apparatus 10 includes an S-shaped roller chain housing assembly 50 that includes proximal and distal portions, 52 and 54, respectively, relative to an associated top drive unit or one or more operably connected components. In the example in FIG. 2, the proximal portion 52 of the roller chain housing assembly 50 is operably coupled to a T-shaped connector or gooseneck assembly 42, and in some embodiments additionally with a pack-off body 22. This may be connected to roller chain housing assembly 50 in any manner, including, for example, a threaded engagement, a bolted engagement, a weld, and may be sealed or not sealed. The pack-off body 22 is designed to provide a seal between the wireline 20 and debris that may come out of the top drive unit 18 during drilling operations. As such, the pack-off body 22 may include a wiper or other components that help maintain the wireline. Standard pack-offs with standard pack-off elements will typically seal with a stationary 7.94×10−3 m (5⁄16 inch) wireline at about (3.4×107 to 7.9×107 Pa) (5,000 to 10,000 psi), depending on the condition of the wireline; i.e., if the wireline is packed or covered with grease or well-oiled, then the seal pressure may be higher. A mounting bracket 26 may operably couple the top entry wireline apparatus 10 to the T-shaped connector 42.

The pack-off body 22 when present mates with a T-shaped connector 42, which in turn mates with a flange 24 to operably couple the top entry wireline apparatus 10 to the top drive unit 18. In certain embodiments, the flange 24 is welded, clamped or threadably secured as with bolts or pins, to the T-shaped connector 42, however, one or more aspects of the present disclosure are readily adaptable to any type of connection as deemed necessary by one of ordinary skill in the art. The flange 24 may be operably coupled directly to a portion of the top drive unit 18 (FIG. 1) or to a bonnet 46, which is configured to cover or mate with a portion the top drive unit 18, thereby operably coupling the top entry wireline apparatus 10 to the top drive unit 18. In certain embodiments, the flange 24 is welded, clamped or threadably secured to the bonnet 46 as with bolts or pins, however, one or more aspects of the present disclosure are readily adaptable to any type of connection as deemed necessary by one of ordinary skill in the art.

Figure 3:
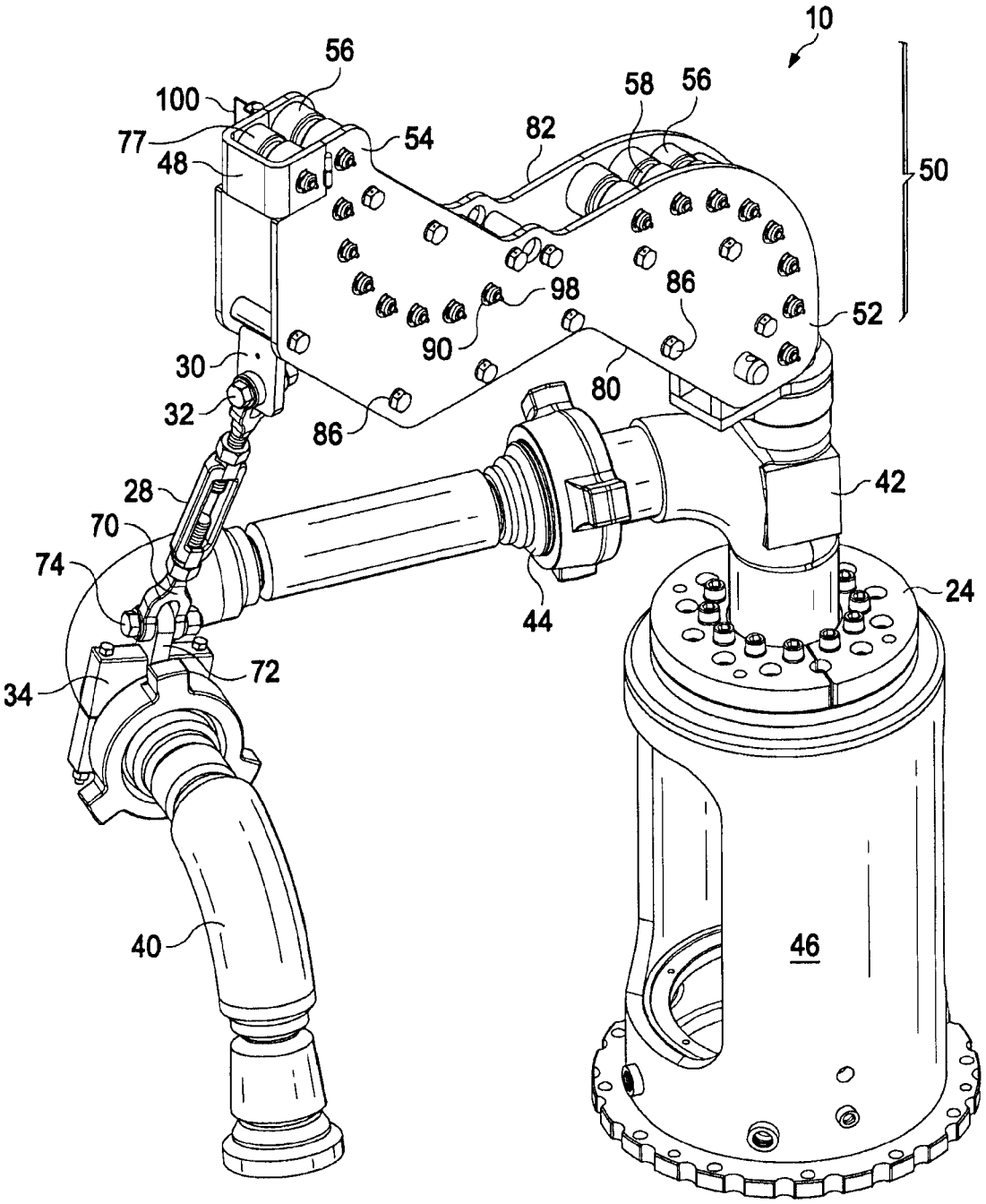
FIG. 3 is a perspective view of the top entry wireline apparatus without the pack-off body installed thereon according to one or more aspects of the present disclosure.

FIG. 3 shows a perspective of the top entry wireline apparatus 10 without the pack-off body 22, according to another embodiment. In this embodiment, the roller chain housing assembly 50 couples with the T-shaped connector 42. The T-shaped connector 42 is coupled to the flange 24. The flange 24 is operably coupled to the bonnet 46 in the depicted embodiment, which is configured to cover or mate with a portion of the top drive unit 18, thereby operably coupling the top entry wireline apparatus to the top drive unit 18.

Figure 4:
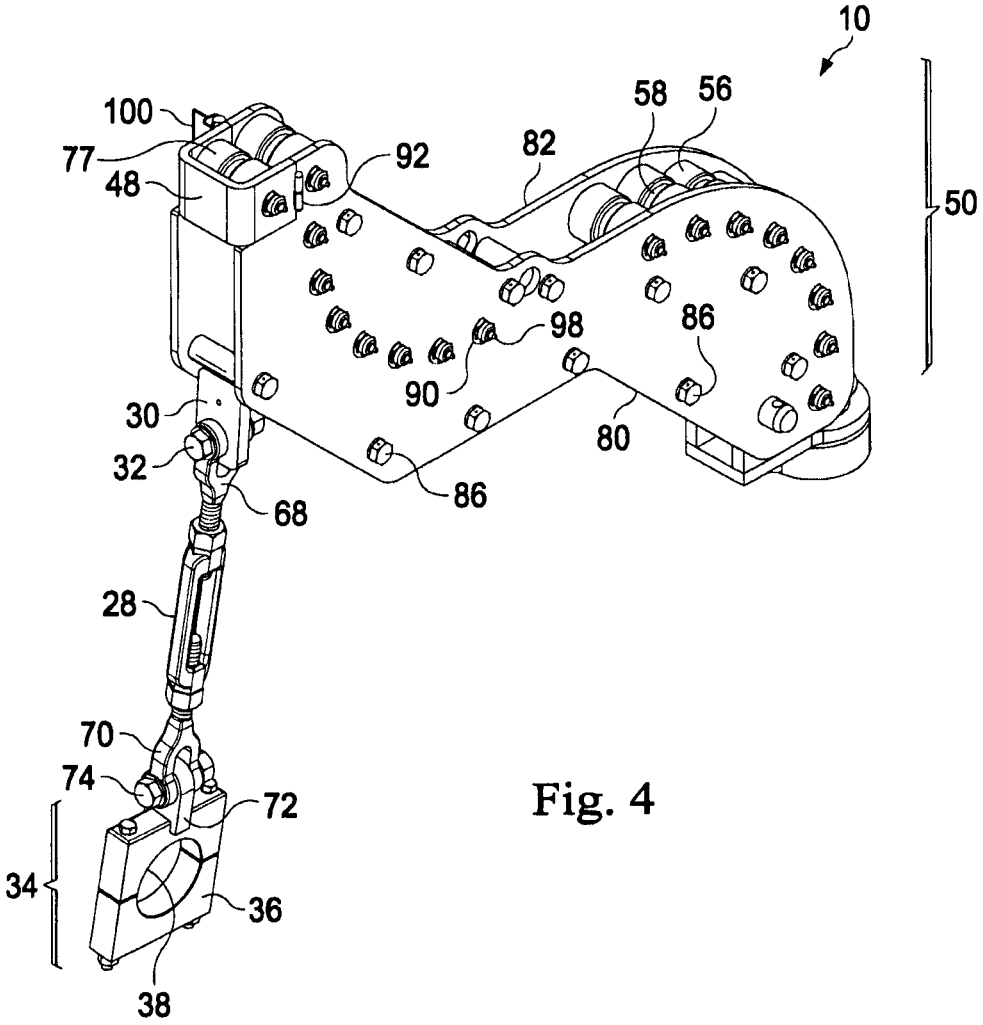
FIG. 4 is a perspective view of the top entry wireline apparatus without the pack-off body installed thereon according to one or more aspects of the present disclosure.

The exemplary top entry wireline apparatus 10 of FIGS. 2 and 3 further includes a turnbuckle assembly 28 operably coupled to the apparatus 10 at the distal portion 54 of the roller chain housing assembly 50, which may be via a latch 30 on the distal portion 54 of the roller chain housing assembly 50, the latch 30 being operably configured to mate with a forked end 68 of the turnbuckle assembly 28 and secured with a nut-and-bolt assembly 32. However, one or more aspects of the present disclosure are readily adaptable to any type of connection as deemed necessary by one of ordinary skill in the art. The turnbuckle assembly 28 is further coupled to a mudline clamp 34, whereby a forked end 70 of the turnbuckle assembly 28 is mated with a latch 72 on the adjacent end of the mudline clamp 34, such as via a nut-and-bolt assembly 74. However, one or more aspects of the present disclosure are readily adaptable to any type of connection as deemed necessary by one of ordinary skill in the art. In the example shown in FIG. 4, the mudline clamp 34 includes a rectangular piece of metal 36 with a circular throughway 38. The circular throughway 38 is operably configured to receive a pipe 40. In certain embodiments, the pipe 40 (FIGS. 2 and 3) feeds mud down to the wellbore via the top drive unit 18. The T-shaped connector 42 of the top entry wireline apparatus 10 is operably configured to receive the terminal end of the pipe 40 at a connection point 44.

Figure 5:
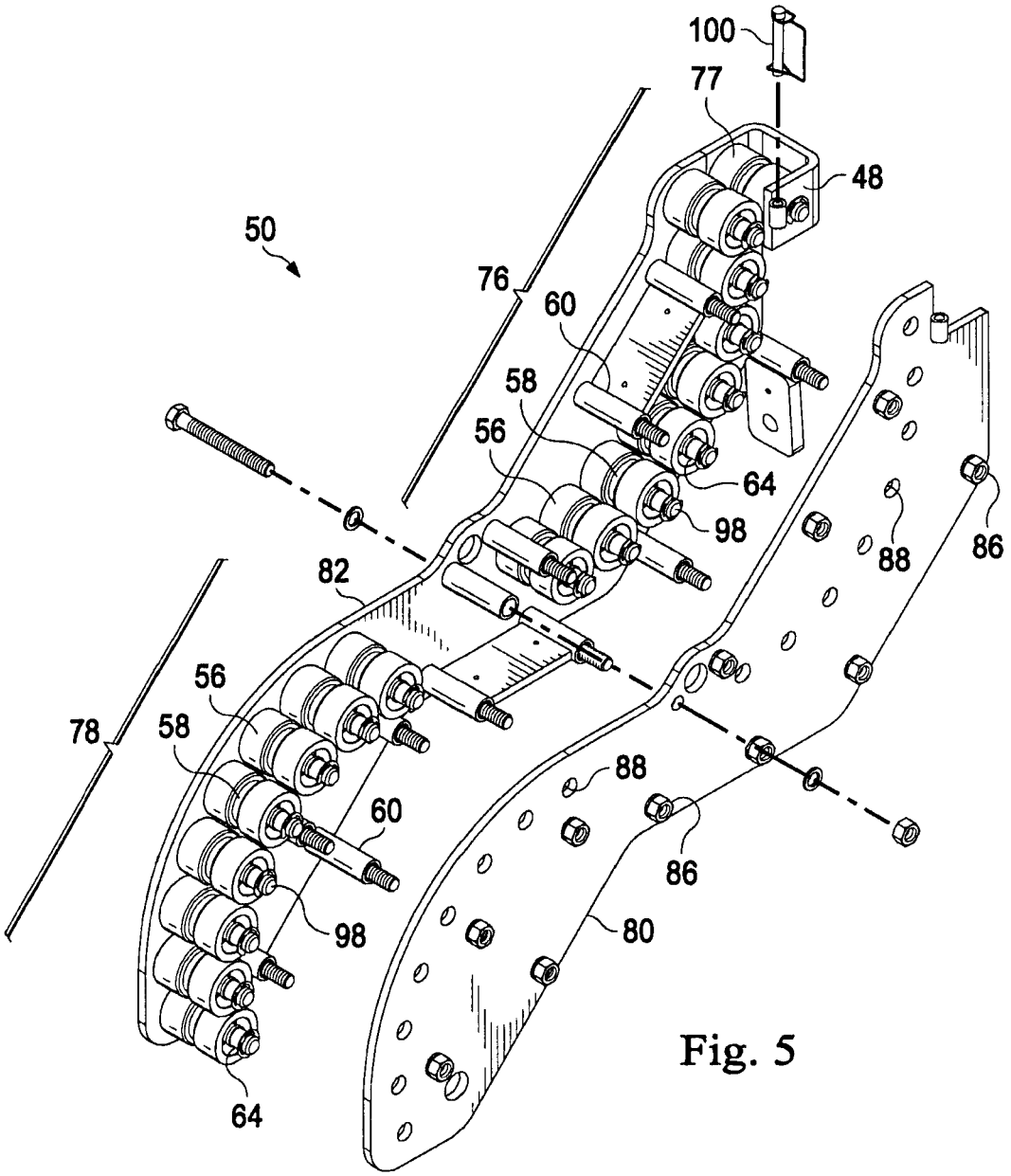
FIG. 5 is an exploded view of a roller chain housing assembly of the top entry wireline apparatus according to one or more aspects of the present disclosure.
Figure 6:
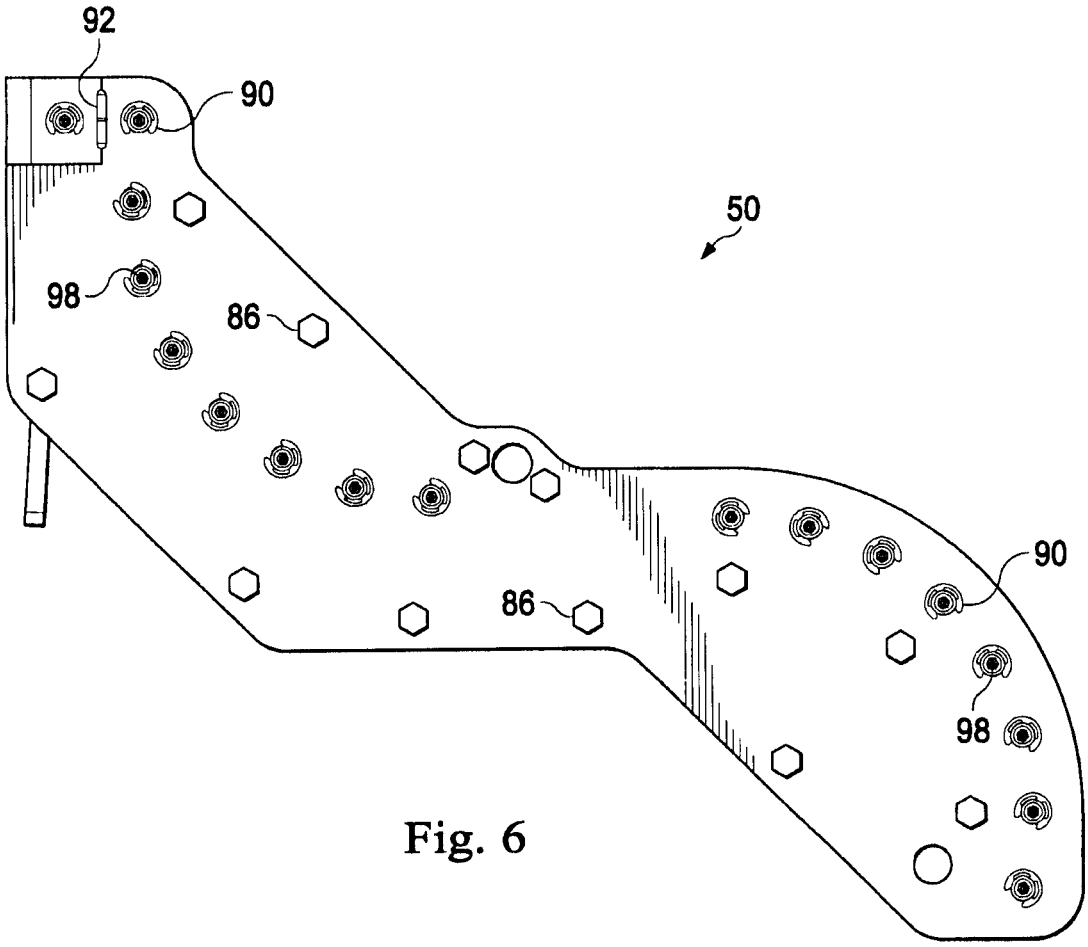
FIG. 6 is a side view of the roller chain housing assembly according to one or more aspects of the present disclosure.
Figure 7:
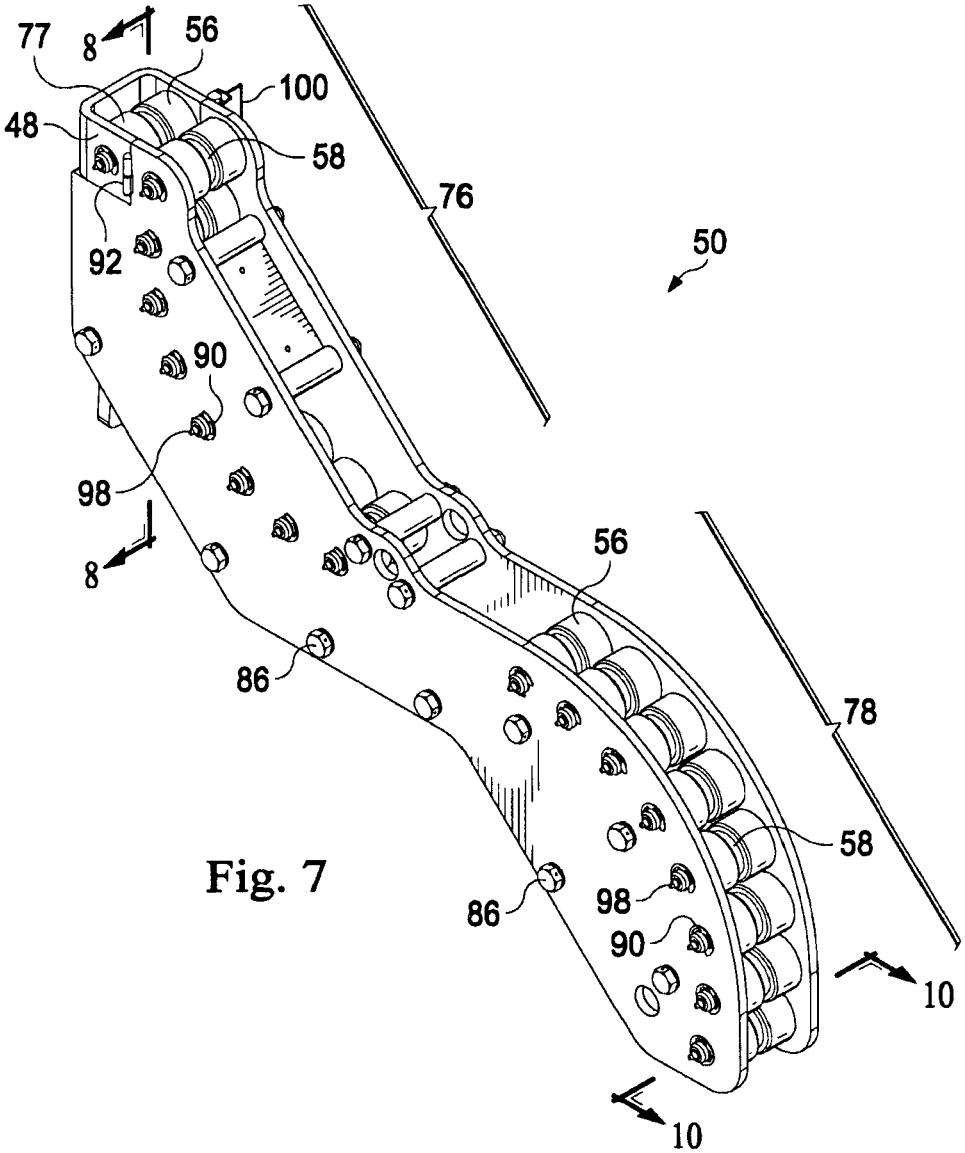
FIG. 7 is a perspective view of the roller chain housing assembly according to one or more aspects of the present disclosure.
Figure 8:
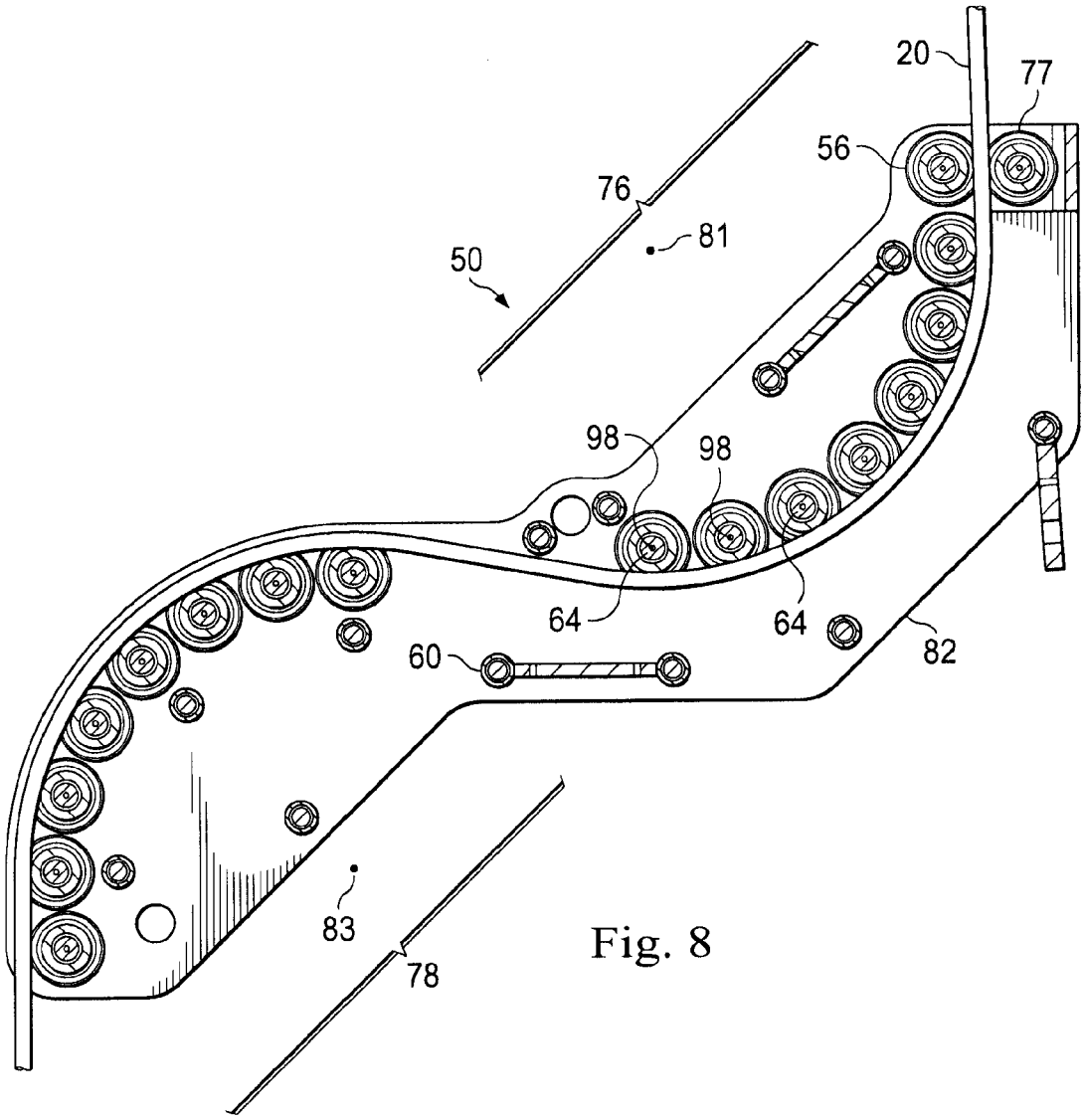
FIG. 8 is a cross-section of the roller chain housing assembly along the line 8-8 shown in FIG. 7 according to one or more aspects of the present disclosure.
Figure 9:
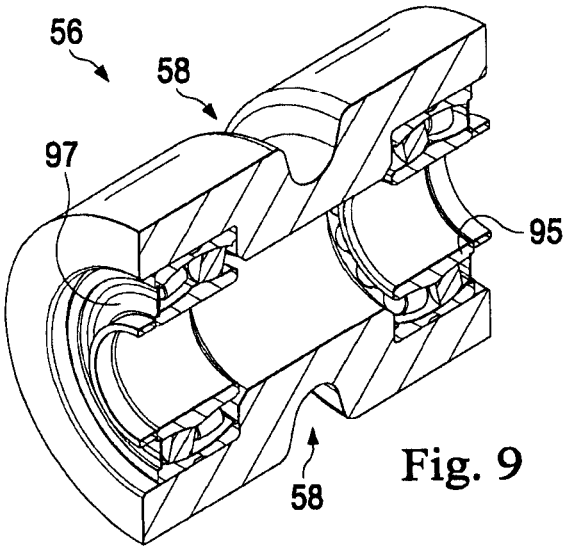
FIG. 9 is a perspective view of a cross-section of a roller body of the roller chain housing assembly along the cross-section 10-10 shown in FIG. 7 according to one or more aspects of the present disclosure.

Referring now to FIG. 5, a partially exploded view of the roller chain housing assembly 50 is shown and includes a receiving side wall 80 and a roller side wall 82. Here, the roller side wall 82 carries a first roller chain 76, a second roller chain 78, a plurality of spacer bolts 60, and a hinged door 48. Conventional systems have typically included pulley and sheave systems in place of the roller chains described herein. Using a system of rollers, such as arranged in first and second roller chains 76, 78 as depicted, reduces the axial space requirements of the top entry wireline apparatus 10. This is important due to the limited axial space often available between the top drive unit 18 and other drilling rig equipment, such as drilling blocks and hooks.

Figure 10:
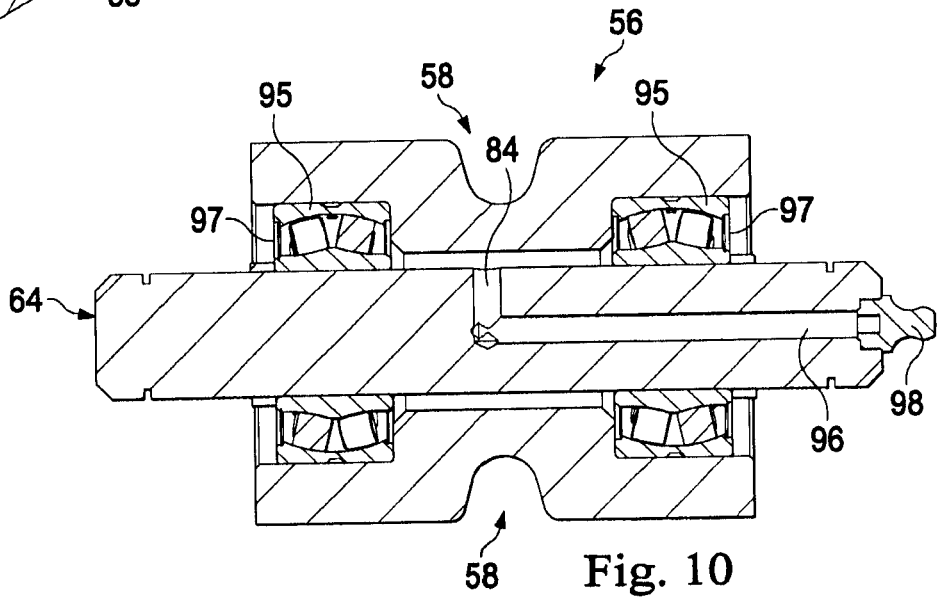
FIG. 10 is a cross-section of the roller body coupled with a bearing pin having a lubrication channel along the cross-section 10-10 shown in FIG. 7 according to one or more aspects of the present disclosure.
Figure 11:
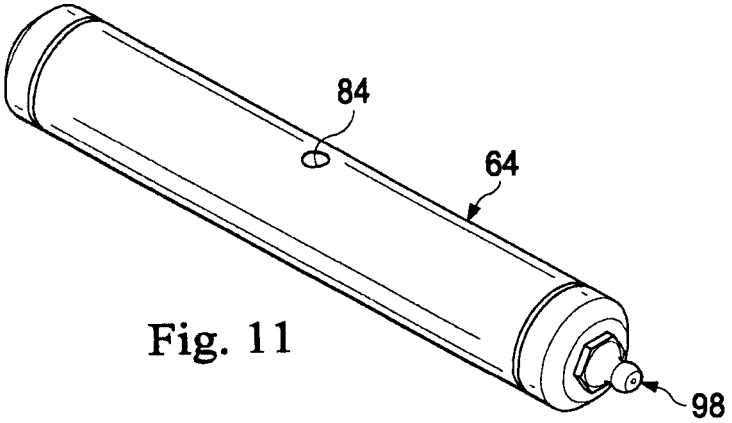
FIG. 11 is a representation of the bearing pin according to one or more aspects of the present disclosure.

The first roller chain 76 and the second roller chain 78 include a plurality of roller bodies 56, which may be secured to the roller side wall 82 with a plurality of bearing pins 64. FIG. 10 shows a cross-section of a roller body 56 with a bearing pin 64, and FIG. 11 shows a representation of one of the bearing pins 64. As shown in FIG. 10, one bearing pin 64 of the plurality of bearing pins 64 traverses one roller body 56 of the plurality of roller bodies 56. Each bearing pin of the plurality of bearing pins 64 includes a pin head 98 and an opening 84 (FIG. 10), which leads to a lubrication channel 96 (FIG. 10) extending between the pin head 98 and the opening 84. The lubrication channel 96 may traverse approximately half of the bearing pin 64 as shown in FIG. 10, and may be pressurized with lubrication oil or grease to help maintain the lubrication of the wireline 20 as it is guided through roller chain housing assembly 50.

In this embodiment, each roller includes bearings 95 and one-way seals 97. Using the pin head 98, which may also be a grease nipple, an operator may inject grease through the lubrication channel 96 and into the cavity of the roller body 56. Injected grease may be forced to flow through and lubricate the bearings 95. Additional grease may cause grease to flow out of the one-way seals 97. Accordingly, an operator may visually see grease flowing from the seal of the roller body 56 and conclude that the bearings are sufficiently lubricated. In addition, the one-way seals 97 prevent the ingress of contaminating elements, such as dirt, water, or other contaminants, into the bearings.

In certain embodiments, the first roller chain 76 includes nine of the roller bodies 56 in a j-shaped convex arcuate configuration (viewed from the bottom of FIG. 5), such as with eight of the roller bodies 56 located along the top side of the arc, and one roller body on the lower side of the arc. As such, the first roller chain 76 forms an arcuate shape about a point 81 located above the roller chain and above the receiving side wall 80 and the roller side wall 82. One or more aspects of the present disclosure are readily adaptable to any number of roller bodies 56. In some examples, each roller chain 76, 78 includes between about four to sixteen roller bodies. In other examples, each roller chain 76, 78 includes between about six to fourteen roller bodies. In some examples, the roller bodies are all uniform in size. In other examples, the roller bodies differ in size, depending upon the size of the wireline and design requirements of the top drive unit. In some embodiments, the roller bodies are primarily comprised of steel. In alternative embodiments, the roller bodies are primarily comprised of aluminum, plastic, or combinations thereof. In some embodiments, the top entry wireline apparatus includes a securement roller body 77 on the outer radius or lower side of the arc formed by the roller chain 76. This securement roller body 77 is secured to the hinged door 48 instead of the roller side wall 82.

In certain embodiments, the second roller chain 78 includes eight of the roller bodies 56 in a concave arcuate configuration, with the eight of the roller bodies 56 located along the lower side of the arc. As such, the second roller chain 78 forms an arcuate shape about a point 83 located below the second roller chain 78 and below the receiving side wall 80 and the roller side wall 82. One or more aspects of the present disclosure are readily adaptable to any number of roller bodies 56, for example, about four to sixteen roller bodies, or about six to fourteen roller bodies. As shown in FIGS. 2, 3, 5, 7, 9, and 10, each roller body in the plurality of roller bodies 56 includes a recess 58 about an outside circumference of each roller body located generally in the middle of the roller body 56 and being operably configured to guide the wireline 20 through the roller chain housing assembly 50. In one or more aspects of the present disclosure, the recess 58 additionally retains the wireline 20 in close cooperation with one or more roller bodies 56. In one or more aspects of the present disclosure, the circumference of the recess 58 is sized according to the size of the wireline 20 that is used.

In the exemplary embodiments shown, the hinged door 48 is located at the distal portion 54, e.g., at the top of a distal end, of the roller chain housing assembly 50 and is configured to secure the securement roller body 77. As can be seen, the securement roller body 77 is located distally along the arc in the first roller chain 76. The hinged door 48 includes a hinge 92 and a handle 100 to facilitate the threading of the wireline 20 into the recesses 58 of the plurality of roller bodies 56. In prior art systems using a pulley and sheave arrangement, threading the wireline onto the first pulley is a difficult and time-consuming operation. In the present disclosure, however, the handle 100 may be operated to open the hinged door 48, exposing the recess 58 distally located first roller body 56 secured to the roller side wall 82, enabling the wireline 20 to be easily fed into the recess 58. When the door is closed, the recess 58 of the securement roller body 77 that is secured to the hinged door 48 also receives the wireline 20, enabling efficient and easy threading of the wireline 20 through the entire roller chain housing assembly 50.

Referring again to FIG. 5, the receiving side wall 80 connects to the roller chain side wall 82 via spacer bolts 60 that extend through one or both of the receiving side wall 80 and the roller chain side wall 82 and are secured via nuts 86. Each of the nuts 86 is operably configured to receive one pin of the plurality of spacer bolts 60 associated with the roller side wall 82 to operably couple the receiving side wall 80 to the roller chain side wall 82. In one or more aspects of the present disclosure, the number of the plurality of spacer bolts 60 and the plurality of nuts 86 can be customized depending on the size and operating requirements of the roller chain housing assembly. Although disclosed as being connected via spacer bolts 60 and nuts 86, the receiving and roller chain side walls may be connected via any suitable type of connection.

The receiving side wall 80 further includes a plurality of roller holes 88 which are operably configured to receive the bearing pins 64. As shown in FIGS. 2, 3, 4, 6, and 7, the bearing pins 64 may be secured in the roller holes 88 via a snap ring 90, or any other connection one of ordinary skill in the art might deem appropriate. As such, the bearing pins include snap ring grooves formed on both ends. Because each bearing pin 64 is individually maintained, an operator easy access to the plurality of roller bodies 56, enabling individual replacement and repair of the roller bodies as needed.

In use, an operator may feed a conduit, such as a wireline, through the top entry wireline apparatus 10 into the T-shaped connector 42, through a top drive, and into a drill string being driven by the top drive. To do this, the operator may lead the wireline from a location such as the wireline supply 12 (FIG. 1), up to the top entry wireline apparatus 10. The operator may open the hinged door 48, thereby separating the securement roller 77 from the first roller chain 76. The wireline may then be introduced between the securement roller 77 and the first roller chain 76. With the wireline disposed in place, the operator may close the hinged door to capture the wireline between the securement roller 77 and the first roller chain 76. Then the wireline may be fed under the first roller chain and above the second roller chain to a location directly above well center. This may include arranging the wireline in the recesses formed in each of the rollers of the roller chains. The wireline may then be fed through the pack-off assembly, if present, and through the T-shaped connector 42, and down through the top drive and through the drill pipe.

The disclosure encompasses wireline apparatus having a receiving side wall comprising a plurality of first roller holes; a roller side wall comprising a plurality of second roller holes; a first roller chain comprising a first plurality of roller bodies disposed to form an arcuate shape about a point above the receiving side wall and the roller side wall, the first plurality of roller bodies being connected between the roller side wall and the receiving side wall; a second roller chain comprising a second plurality of roller bodies disposed to form an arcuate shape about a point below the receiving side wall and the roller side wall, the second plurality of roller bodies being connected between the roller side wall and the receiving side wall; and a plurality of bearing pins each supporting one of the roller bodies of the first and second pan apparatus having a proximal portion adjacent a top drive unit and a distal portion, wherein the apparatus includes a receiving side wall and a roller side wall. In some aspects, the apparatus further includes a hinged door and a securement roller body, the securement roller body being carried by the hinged door and being disposed to cooperate with the first roller chain to capture a wireline therebetween. In some aspects, the first plurality of roller bodies comprises a recess formed therein operably configured to receive and guide a wireline. In some aspects, the recess is a circumferential recess. In some aspects, the receiving side wall and the roller side wall include a proximal end and a distal end, the first roller chain being disposed at the proximal end and the second roller chain being disposed at the distal end. In some aspects, the apparatus further includes a removable pack-off assembly operably coupled to the distal end of the receiving side wall and the roller side wall. In some aspects, the apparatus further includes a turnbuckle assembly, wherein said turnbuckle assembly is operably coupled to the distal portion of the apparatus. In some aspects, the apparatus further includes a mudline clamp, wherein said mudline clamp is operably coupled to the distal end of the turnbuckle assembly and configured to attach to a mudline on a drilling rig. In some aspects, the apparatus further comprises a t-shaped connector connecting the mudline clamp to a location below the distal portion of the receiving side wall and the roller side wall. In some aspects, the apparatus is operably configured to accept a conduit. In some aspects, the conduit can be wireline, slickline, coiled tubing, fiber optic cable, electrical conduit, or a combination thereof. In some aspects, the plurality of roller bodies are arranged to guide the conduit through the apparatus. In some aspects, each bearing pin of the plurality of bearing pins includes a lubrication channel. In some aspects, the lubrication channel traverses a central portion along part of the bearing pin. In some aspects, each roller of the first plurality of roller bodies comprises bearings and one-way seals. In some aspects, the one-way seals are arranged to permit passage of grease out of the respective roller body. In some aspects, the first roller chain and the second roller chain each include about four to fourteen roller bodies. In some aspects, the plurality of bearing pins are operably secured to the roller holes via a snap ring.

The present disclosure also introduces a wireline apparatus including a receiving side wall; a roller side wall; a first roller chain disposed between the receiving side wall and the roller side wall; a second roller chain disposed between the receiving side wall and the roller side wall, the first and the second roller chains together forming an S-shape for the direction of a wireline; and a securement roller body adjacent the first roller chain, the securement roller being displaceable between a first location securing a wireline between the first roller chain and the securement roller body and a second location allowing the wireline to be laterally introduced between or removed from between the first roller chain and the securement roller body. In some aspects, the apparatus further includes a hinged door, the securement roller body being carried by the hinged door between the first and second locations. In some aspects, the first roller chain further includes a first plurality of roller bodies disposed to form an arcuate shape about a point above the receiving side wall and the roller side wall. In some aspects, the second roller chain comprises a second plurality of roller bodies disposed to form an arcuate shape about a point below the receiving side wall and the roller side wall. In some aspects, the apparatus further includes a plurality of bearing pins supporting the first and second roller chains, the bearing pins being operably configured to extend through holes in the receiving side wall and the roller side wall. and the second roller chain includes about four to twelve of the plurality of the roller bodies.

The present disclosure also introduces a method including: securing a roller chain housing assembly apparatus to an upper portion of a top drive unit, wherein the apparatus is adapted to laterally guide a conduit to an aperture in the top drive unit under a first roller chain comprising a first plurality of roller bodies disposed to form an arcuate shape about a point above the first roller chain and over a second roller chain comprising a second plurality of roller bodies disposed to form an arcuate shape about a point below the second roller chain; running the conduit through the roller chain housing assembly apparatus and into the top drive unit aperture, wherein the top drive is operably coupled to a drill string; and introducing the conduit into a bore in the drill string. In some aspects, the method further includes opening a door to feed the conduit through the roller chain housing assembly apparatus and closing the door to capture the conduit against a portion of the first roller chain. In some aspects, the method further includes a securement roller on the door that is moveable with the door. In some aspects, the method further includes rotating the drill string with at least the top drive unit while the conduit is present in the drill string. In some aspects, the method further includes attaching a downhole tool to a portion of the conduit disposed in the drill string.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. A wireline apparatus, comprising:

a receiving side wall comprising a plurality of first roller holes disposed to form an arcuate shape;

a roller side wall comprising a plurality of second roller holes disposed to form an arcuate shape;

a first roller chain comprising a first plurality of roller bodies disposed to form an arcuate shape about a point above the receiving side wall and the roller side wall, the first plurality of roller bodies being connected between the roller side wall and the receiving side wall;

a second roller chain comprising a second plurality of roller bodies disposed to form an arcuate shape about a point below the receiving side wall and the roller side wall, the second plurality of roller bodies being connected between the roller side wall and the receiving side wall;

a plurality of bearing pins each supporting one of the roller bodies of the first and second pluralities of roller bodies, the pins being operably configured to couple with the plurality of first and second roller holes; and a hinged door and a securement roller body, the securement roller body comprising a roller, being carried by the hinged door and being disposed to cooperate with the first roller chain to capture a wireline therebetween.

2. The apparatus of claim 1, wherein the first plurality of roller bodies comprises a recess formed therein operably configured to receive and guide a wireline.

3. The apparatus of claim 2, wherein the recess is a circumferential recess.

4. The apparatus of claim 1, wherein the receiving side wall and the roller side wall comprise a proximal portion and a distal portion, the first roller chain being disposed at the proximal portion and the second roller chain being disposed at the distal portion, the apparatus further comprising a removable pack-off assembly operably coupled to the proximal portion of the receiving side wall and the roller side wall.

5. The apparatus of claim 4, further comprising a turnbuckle assembly, wherein said turnbuckle assembly is operably coupled to the distal portion of the apparatus.

6. The apparatus of claim 5, further comprising a mudline clamp, wherein said mudline clamp is operably coupled to a distal end of the turnbuckle assembly and configured to attach to a mudline on a drilling rig.

7. The apparatus of claim 6, wherein the receiving side wall and the roller side wall comprise a proximal end and a distal end, the first roller chain being disposed at the proximal end the second roller chain being disposed at the distal end, the apparatus further comprising a t-shaped connecter connecting the mudline clamp to a location below the distal end of the receiving side wall and the roller side wall.

8. The apparatus of claim 1, wherein the apparatus is operably configured to accept and displace a conduit.

9. The apparatus of claim 8, wherein the conduit comprises at least one of wireline, slickline, coiled tubing, fiber optic cable, electrical conduit, or a combination thereof.

10. The apparatus of claim 1, wherein the first roller chain and the second roller chain each comprise between about four to fourteen roller bodies.

11. The apparatus of claim 1, wherein the plurality of bearing pins are operably secured to the roller holes via a snap ring.

12. A wireline apparatus, comprising:

a receiving side wall comprising a plurality of first roller holes;

a roller side wall comprising a plurality of second roller holes;

a first roller chain comprising a first plurality of roller bodies disposed to form an arcuate shape about a point above the receiving side wall and the roller side wall, the first plurality of roller bodies being connected between the roller side wall and the receiving side wall;

a second roller chain comprising a second plurality of roller bodies disposed to form an arcuate shape about a point below the receiving side wall and the roller side wall, the second plurality of roller bodies being connected between the roller side wall and the receiving side wall;

a plurality of bearing pins each supporting one of the roller bodies of the first and second pluralities of roller bodies, the pins being operably configured to couple with the plurality of first and second roller holes;

wherein each bearing pin of the plurality of bearing pins comprises a lubrication channel, wherein the lubrication channel traverses a central portion along part of the bearing pin, and wherein each roller of the first plurality of roller bodies comprises bearings and one-way seals, the one way seals being arranged to permit passage of grease out of the respective roller body.

13. A wireline apparatus, comprising:

a receiving side wall;

a roller side wall;

a first roller chain disposed between the receiving side wall and the roller side wall;

a second roller chain disposed between the receiving side wall and the roller side wall, the first and the second roller chains together forming an S-shape for the direction of a wireline;

a securement roller body adjacent the first roller chain, the securement roller body comprising a roller and being displaceable between a first location securing a wireline between the first roller chain and the securement roller body and a second location allowing the wireline to be laterally introduced between or removed from between the first roller chain and the securement roller body.

14. The apparatus of claim 13, further comprising a hinged door, the securement roller body being carried by the hinged door between the first and second locations.

15. The apparatus of claim 13, wherein the first roller chain comprises a first plurality of roller bodies disposed to form an arcuate shape about a point above the receiving side wall and the roller side wall.

16. The apparatus of claim 15, wherein the second roller chain comprises a second plurality of roller bodies disposed to form an arcuate shape about a point below the receiving side wall and the roller side wall.

17. The apparatus of claim 13, comprising a plurality of bearing pins supporting the first and second roller chains, the bearing pins being operably configured to extend through holes in the a receiving side wall and the roller side wall.

18. A method, comprising:

securing a roller chain housing assembly apparatus to an upper portion of a top drive unit, the roller chain housing assembly apparatus being adapted to laterally guide a conduit to an aperture in a top drive unit under a first roller chain comprising a first plurality of roller bodies disposed to form an arcuate shape about a point above the first roller chain, and over a second roller chain comprising a second plurality of roller bodies disposed to form an arcuate shape about a point below the second roller chain;

opening a door comprising a securement roller on the door that is moveable with the door to feed the conduit through the roller chain housing assembly apparatus; and closing the door to capture the conduit between the securement roller and a portion of the first roller chain;

running the conduit through the roller chain housing assembly apparatus and into the top drive unit aperture, wherein the top drive is operably coupled to a drill string; and introducing the conduit into a bore in the drill string.

19. The method of claim 18, wherein the method further includes rotating the drill string with at least the top drive unit while the conduit is present in the drill string.

20. The method of claim 18, wherein the method further includes attaching a downhole tool to a portion of the conduit disposed in the drill string.

* * * * *